United States Patent [19]

Toleikis, Jr.

[11] 4,099,996

[45] Jul. 11, 1978

[54] PROCESS FOR HEAT-TREATING THE HEAD OF RAILROAD RAIL

[75] Inventor: John Toleikis, Jr., Whiting, Ind.

[73] Assignee: United States Steel Corporation, Pittsburgh, Pa.

[21] Appl. No.: 801,489

[22] Filed: May 31, 1977

[51] Int. Cl.[2] ..... C21D 1/78

[52] U.S. Cl. ..... 148/131; 148/146; 148/152; 266/119

[58] Field of Search ..... 148/131, 150–154, 148/155, 12 B, 134, 146, 130; 72/700; 266/119, 115, 249, 114; 219/10.73

[56] References Cited

U.S. PATENT DOCUMENTS

| | | | |
|---|---|---|---|
| Re. 27,221 | 11/1971 | Dewez, Jr. et al. | 148/131 |
| 3,662,995 | 5/1972 | Armstrong | 148/131 |

FOREIGN PATENT DOCUMENTS

| | | | |
|---|---|---|---|
| 1,537,355 | 7/1968 | France | 148/131 |
| 398,644 | 2/1974 | U.S.S.R. | 148/131 |

*Primary Examiner*—L. Dewayne Rutledge
*Assistant Examiner*—Peter K. Skiff
*Attorney, Agent, or Firm*—Forest C. Sexton

[57] ABSTRACT

In the process of heat-treating the head of a railroad rail wherein the rail is stressed so that the head forms a convex arc of predetermined height, the arc height is decreased about 14% after about 10% of the rail head has been heated, and then the original arc height is restored when about 40% of the rail head has been heated and then again decreased when about 60% of the rail head has been heated, and then finally the original arc height is again restored while the last 10% of the rail head length is heat treated.

3 Claims, 2 Drawing Figures

PROCESS FOR HEAT-TREATING THE HEAD OF RAILROAD RAIL

This invention relates generally to the heat-treatment of steel railroad rails, and more particularly to a method of heat-treating the heads of steel railroad rails while in a stressed condition as will minimize distortions.

In the manufacture of steel railroad rails, it is of course common practice to heat-treat the rail to enable it to better withstand the wearing forces to which it will be subjected in service. It is also well known that the entire rail cross-section can be heat-treated, or in the alternative, only the head portion may be heat-treated. Since only the surfaces of the head portion are subjected to the wearing action, heat-treatment of the head portion only provides the obvious advantage of leaving the web and flange portions of the rail in a tougher unheat-treated condition. In addition, heat-treating the rail head only is quicker and utilizes less energy. In earlier prior art practices however, head-only heat-treatment of essentially straight rails did cause distortions in the heat-treated product, such that upon cooling, the rail would have an upward concave curvature. The excessive mechanical forces necessary to restraighten such heat-treated rails often resulted in underside residual stresses which increased the susceptibility to rapid fatigue failure in service.

To overcome the above problems associated with head-only heat-treatment, several techniques were developed whereby the rail head is heat treated while the rail is prestressed in a downward concave curvature. Upon cooling thereafter, the stresses causing the upward concave distortion tend to straighten the rail rather than distort it. The process disclosed in U.S. Pat. No. Re. 27,221 is typical of such processes, and utilizes an elongated clamping device to prestress the rail during heat-treatment. In such a clamping device, one or more rails are mounted upright with one or more rigid supports under the rail flange, while the ends of the rail are clamped downward with reference to the supports thereby flexing the rail ends downward. Thus the entire length of rail is stressed arcuately within its elastic limits so that the head is convex and the flange concave. While the head is prestressed in this condition, the head portion is progressively heat treated from one end to the other. This is usually effected by a treating unit which rolls above the rail head exposing the head first to induction heating and then air quenching the heated head portion.

Although the process as described above does eliminate the need for excessive restraightening of the heat-treated rails, at least to the extent that harmful underside residual stresses would be imposed, such heat-treated rails still usually require some degree of straightening. Such straightening procedures not only add to the cost of rail production, but typical production facilities often experience serious bottleneck problems at the straightening press. Although this could be overcome by providing additional presses and personnel to operate them, that would obviously further increase the cost of production.

An object of this invention is to provide a process for heat-treating railroad rail heads which eliminates or minimizes rail distortions.

Another object of this invention is to provide new methods of prestressing railroad rails during the time the rail head is being heat-treated to thereby eliminate or minimize rail distortions.

A further object of this invention is to provide an apparatus of heat-treating railroad rail heads wherein the rail is subjected to variable operating conditions while the rail head is being heat-treated to eliminate or minimize rail distortions.

Still another object of this invention is to provide an improved railroad rail having a heat-treated head and essentially free of distortions and residual stresses which could reduce the life of the rail in service.

With reference to the attached drawings.

As noted above, rails heat-treated pursuant to the process as taught in U.S. Pat. No. Re. 27,221 are usually not as straight as might be desired. Despite the fact that very careful calculations have determined the exact amount of arc necessary to result in a straight rail, it has been learned that a rail will not maintain a fixed arc during heat-treatment. That is to say, as the rail head is heated it naturally has a tendency to expand, so that after a short heating interval, the clamped rail head elongates slightly, which tends to increase the preset arc. This change in arc can be significant enough to actually cause portions of the rail to lift upwardly and off-of a midsection support. To overcome this change in arc during the heat treatment, I have developed a process and apparatus which will tend to maintain the preselected arc during the heat-treatment.

Figure 2:
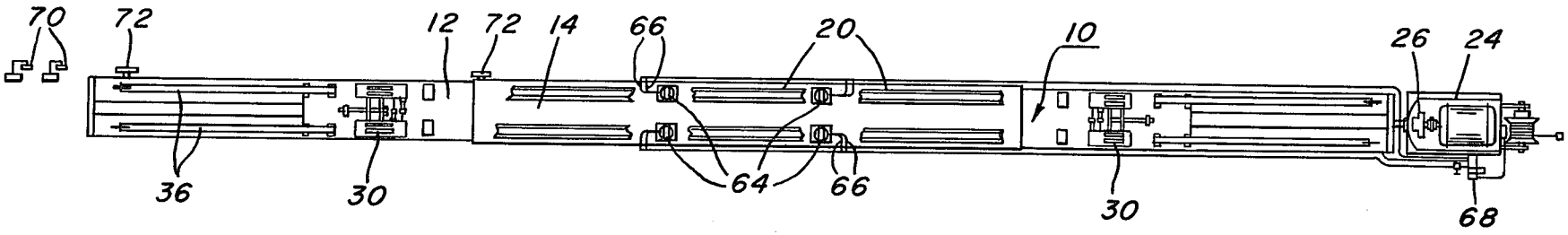
FIG. 2 is a plan view of the apparatus shown in FIG. 1.
Figure 1:
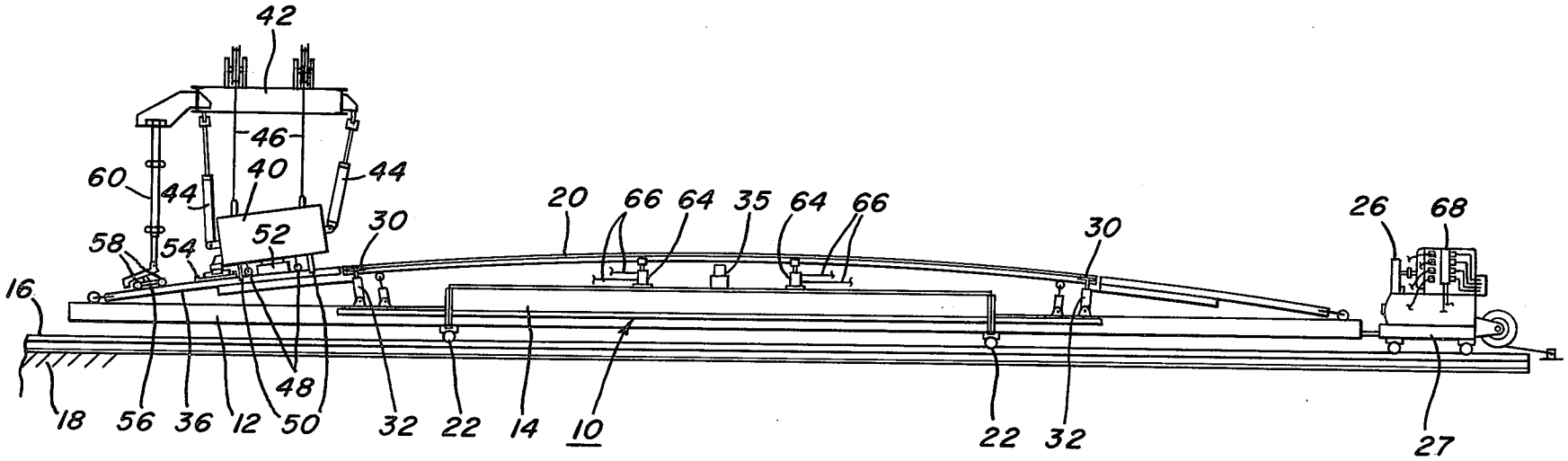
FIG. 1 is an elevational view illustrating apparatus according to one embodiment of this invention.

With reference to the drawings, one embodiment of apparatus as may be used pursuant to this invention comprises a rigid, elongated transport frame or carriage 10, made principally of two beams 12 and 14, adapted to travel along rails 16 within floor surface 18. Carriage 10 is also adapted to support and hold a pair of rails 20, each having a head, web and flange bent longitudinally as shown, with the head portion convex upwardly and the flange portion concave downwardly in a vertical plane. For travel along rails 16, carriage 10 is provided at intervals with wheels 22 (FIG. 2). A car 24, carrying a motor driven hydraulic pump 26 for supplying hydraulic auxiliaries to be described subsequently, is coupled to one end of carriage 10 and is adopted to travel along rails 16 with carriage 10. A drive motor (not shown) is provided to drive carriage 10 and car 24 at a constant slow speed along rails 16, from right to left as viewed from the drawings. For details as to how such a drive motor may be incorporated, see U.S. Pat. No. Re. 27,221.

At each end of carriage 10 a suitable rail clamping means is provided which includes a hold-down jaw 30 which is slidable into and out-of engagement with the ends of rails 20. A hydraulic cylinder 32 is provided for actuating each jaw 30, that is, for deflecting the ends of rails 20 downward pivotally about a central unloading clamp 35. Entry quides 36 are also provided at each end of carriage 10 which provides a pair of upper surfaces which align with the upper surfaces of rails 20 when clamped into position as shown.

An induction hardening assembly 40 is suspended directly over carriage 10 from an independent and stationary structural support member 42 on cylinders 44 and cables 46, so that, in the starting position, wheels 48 and guides 50 on the underside of assembly 40 engage entry guides 36. The other end of cables 46 are suitably counter-balanced (not shown) so that assembly 40 is easily raised upward. An induction hardening unit 52 is also positioned on the underside of assembly 40 between wheels 48, while an air quench head 54 is positioned on the lower back side of assembly 40. A water quench head 56, provided with wheels 58 is independently suspended from member 42 on cylinder 60. Wheels 48 and 58 are adapted to roll longitudinally over the upper surface of entry guides 36 and rails 20 as carriage 10 advances thereunder.

The apparatus as described above is substantially the same as that disclosed in U.S. Pat. No. Re. 27,221, and accordingly, represents the current state of the art. The crux of this invention resides in hydraulic cylinders 64. That is, four hydraulically operated cylinders 64 are provided on the upper surface of carriage 10 spaced on either side of clamp 35, such that two cylinders 64 are provided under each rail 20. Rails 20 are bent into an arcuate form by pulling the ends thereof downward with respect to the mid-portions which are supported on cylinders 64. Unloading clamp 35 is used only to hold rails 20 while the ends thereof are being unclamped, and therefore clamp 35 should not contact rails 20 or in any way interfere with the arc height being maintained by cylinders 64. Cylinders 64 are adapted to be raised and lowered during the heat-treatment by fluid supply lines 66 connected to hydraulic pump 26 through suitable controls 68. Hydraulic controls 68 are activated by limit switches 70 mounted on floor 18 at predetermined intervals, which are themselves activated by switch activating arms 72 on the side of carriage 10 spaced at predetermined intervals. Due to limited drawing space, limit switches 70 are shown side-by-side. Obviously these should be suitably spaced apart with reference to the spacing of activating arms 72 to effect the lowering and raising of cylinders 64 at the critical time intervals.

While it is intended that rails 20 be maintained in a prestressed fixed arcuate form as shown throughout the entire heat-treatment, it has been learned that as various portions of the rail head are heated, expansion of the head tends to change the arc when fixed supports remain unchanged. By this invention, the supports, i.e. the height of cylinders 64 are periodically changed during the heat-treatment for the purpose of maintaining a constant arc. Specifically, the process of this invention requires that the rails 20 be clamped onto carriage 10 to provide an arc of predetermined height therein as deemed necessary to produce a straight rail. Then the induction hardening assembly 40 is started and carriage 10 is activated so that it moves from right to left as viewed in the drawings. This motion causes wheels 48 and 58 to roll along the surface of entry guides 36 and eventually onto the heads of rails 20, progressively heating the rail head with induction unit 52, followed by air quenching with air quench head 54, and that followed by water quenching with water quench head 56. After a length of rail of about 10% of its total length has been heated, cylinders 64 are lowered to reduce the arc height about 14%, while heat-treating continues. Subsequently, when about 40% of the rail length has been heated, cylinders 64 raised back to their starting position. Thereafter, when approximately 60% of the rail length has been heated, cylinders 64 are again lowered by the same amount as before. Finally, after about 90% of the rail length has been heated, cylinders 64 are again raised to the starting position, and the heat-treatment is complete as it was started. It is obvious that limit switches 70 and activating arms 72 must be suitably spaced to effect this sequence.

To illustrate a specific application of this invention, apparatus as described above has been built to heat-treat standard sized rails of 39 foot lengths. Rail sizes of from 115 to 136 pounds per yard can be heat-treated thereon. Heat-treating these rails pursuant to prior art practices requires an arc such that there is a 17.5 inch difference in elevation between the rail mid-point and the ends. To start heat-treating such rails, cylinders 64 are raised to maintain such an arc. Although spacing is not particularly critical, cylinders 64 on the apparatus used are spaced 8 feet apart, each 4 feet from the rail mid-point. In this starting position, heat-treatment is commenced and progresses along the rails until about 4 feet of rail length, i.e. about 10%, has been heated by induction heating head 52. At this point, approximately three minutes into the heat-treatment, cylinders 64 are lowered about 2.5 inches, thereby lowering the top of the arc from the 17.5 inch lift to about 15 inches, or about 14%. The heat-treatment continues at this setting until about 16 feet of rail has been heated, whereupon cylinders 64 are again raised to their starting height, i.e. about 2.5 inches higher. After a total of about 23 feet of rail length has been heated, cylinders 64 are again lowered about 2.5 inches, and then raised again for heating the last 4 feet.

It is obvious that the amount of raising and lowering of cylinders 64 will depend upon the distance such cylinders are spaced from the rail mid-point, and the length of the rail being heat-treated, the object of course being that the arc height should be lowered approximately 14% from the starting position and reraised an equal amount when required. It is somewhat critical however, that the lowering and raising motion should not be abrupt, but rather should be effected over a period of time of from 45 to 60 seconds. Lowering or raising times of less than 45 seconds may cause kinks to develop in the finished rail. Lifting and lowering times of more than 60, while not harmful, are unnecessarily prolonged.

I claim:

1. In the process for heat-treating a railroad rail having a head, web and flange wherein the rail is bent within the elastic limit in the plane of the web to form an arc having a predetermined height so that the head is convex and the flange concave, and the head of the rail is heat-treated progressively from one end to the other while holding the rail in such an arcuate condition, said heat treatment involving heating the rail head into the austenitic temperature range followed by a mild quench to form pearlite, the improvement comprising holding the rail in such predetermined arcuate condition while about 10% of the rail head length is heated, thereafter decreasing the height of the arc about 14% while said heat-treatment is continued until about 40% of the rail head has been heated, thereafter increasing the height of the arc to approximately its original height while said heat-treatment is continued until about 60% of the rail head has been heated, thereafter again decreasing the height of the arc about 14% while said heat-treatment is continued until about 90% of the rail head has been heated, thereafter again increasing the height of the arc to approximately its original height while said heat-treatment is continued to the end of the rail, each of said lower and raising of the arc height being effected during a period of at least 45 seconds.

2. A process according to claim 1 in which each of said lowering and raising of the arc height being effected during a period of from 45 to about 60 seconds.

3. A process according to claim 1 in which said rail is approximately 39 feet long and the predetermined arc height is approximately 17.5 inches and said decrease in arc height is approximately 2.5 inches.

* * * * *